United States Patent [19]

Anania, Sr.

[11] 3,967,825

[45] July 6, 1976

[54] EDUCATIONAL GAME HAVING A RANDOM NUMBER SELECTOR

[76] Inventor: James A. Anania, Sr., 801 N. 6th St., No. 716, P.O. Box 186, Newark, N.J. 07107

[22] Filed: May 14, 1975

[21] Appl. No.: 577,233

[52] U.S. Cl. ..... 273/135 B; 273/130 C; 273/135 AC; 273/141 R

[51] Int. Cl.[2] ..... A63F 3/06

[58] Field of Search ... 273/135 B, 135 BC, 135 AC, 273/135 R, 130 C, 130 R, 134 E, 136 K, 141 R, 135 AD, 130 A, 136 B, 141 R, 156, 153 R, 132, 136 K, 135 D

[56] References Cited

UNITED STATES PATENTS

| | | | |
|---|---|---|---|
| 957,800 | 10/1910 | Richardson | 273/135 B |
| 1,457,383 | 6/1923 | Miller | 273/130 C |
| 1,513,500 | 10/1924 | Greig | 273/141 R |
| 1,521,095 | 12/1924 | Harris | 273/135 B |
| 1,655,380 | 1/1928 | Parker | 273/135 B |
| 2,681,804 | 6/1954 | Stover | 273/141 R |
| 3,224,112 | 12/1965 | Hanson | 273/135 BC |
| 3,542,368 | 11/1970 | Ashley | 273/135 B |
| 3,618,951 | 11/1971 | Patrick et al. | 273/135 B |

FOREIGN PATENTS OR APPLICATIONS

| | | | |
|---|---|---|---|
| 12,040 | 3/1890 | United Kingdom | 273/130 C |
| 24,603 | 10/1896 | United Kingdom | 273/130 C |

OTHER PUBLICATIONS

Regal Games Catalog, "Easy Math," 1970.

*Primary Examiner*—Anton O. Oechsle
*Assistant Examiner*—Harry G. Strappello
*Attorney, Agent, or Firm*—Lowe, King, Price & Markva

[57] ABSTRACT

An educational game for playing a game of skill and judgement, the game comprising, a random number selector adapted to receive a disc containing numbers thereon, at least one game board divided into a plurality of rows and columns of four in number, a plurality of numbered tokens for placing at each of the sixteen spaces defined on the game board by the rows and columns, each of said game boards having a numerical solution, the solution being defined by addition of the numbered tokens on the board after all spaces are filled, the addition being in any desired direction of any four of the tokens in abutting relationship. In playing the game the random selector is used to select numbers from a disc and numerical tokens are then placed on the game board until all spaces on each players board are filled, the object of the game being to obtain the correct solution indicated for that particular game.

20 Claims, 5 Drawing Figures

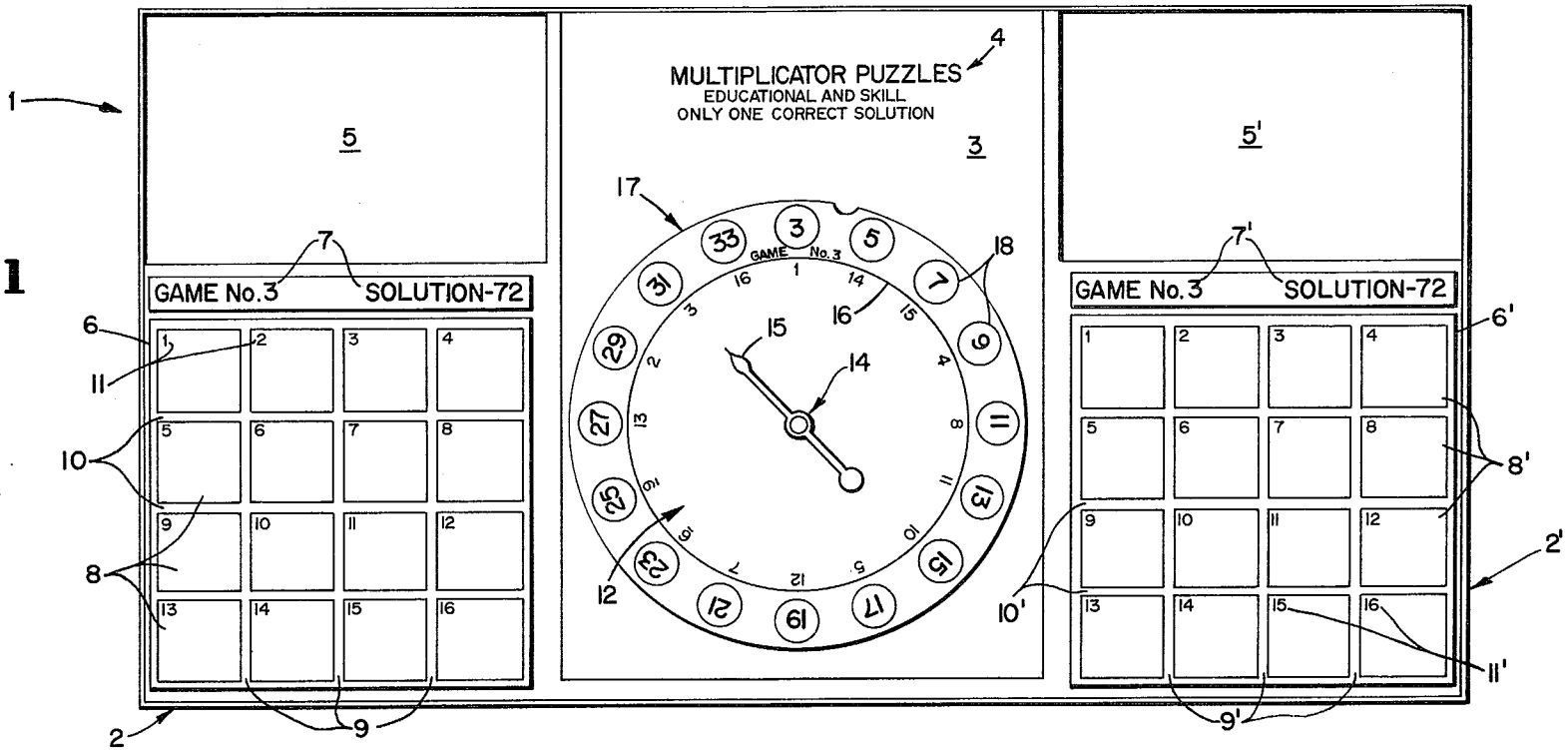
FIG. 1
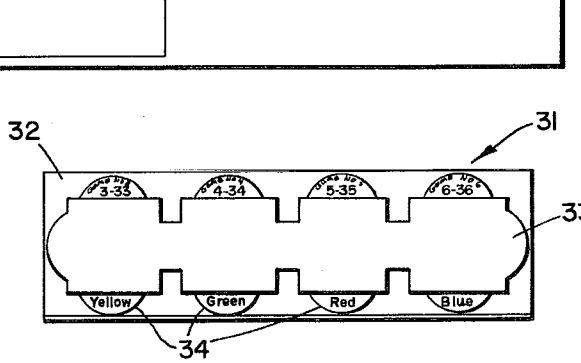
FIG. 5
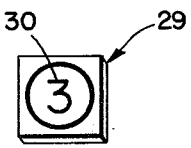
FIG. 3
FIG. 4

EDUCATIONAL GAME HAVING A RANDOM NUMBER SELECTOR

BACKGROUND OF THE INVENTION

1. Field of the Invention

This invention relates to a recreational device and more particularly to an educational game which makes use of mathematical computations and skill to arrive at indicated numerical solutions on game boards.

2. Description of the Prior Art

Various types of numerical games are known to the prior art using a plurality of numbered pieces selectively placed on a given game board in a certain order to indicate one's skill or educational level. Usually prior art devices of this type are used to indicate ones skill in multiplication and subtraction or the like but are not operable in a manner requiring one to foresee the innumerable combinations of present and future plays to pit one players skill against another players skill. Usually the prior art will be found to fall into two categories. One category comprises bingo-like games wherein the player has a card having rows and columns thereon to define a plurality of spaces. Each of the spaces has a number printed thereon and as the leader of the game calls these numbers in random order the player of the game marks those numbers he finds on his card. When the player completes a row or column or diagonal of such markings and he is the first to do so, he is the winner of the game.

This type of game is characterized by the fact that the numbers are already placed on the card, thus no skill is really employed in choosing of numbers or placement of numbers. Accordingly, in another class of numerical game boards, rows and columns are delineated to form related spaces and the player has available to him a plurality of numbers and/or mathematical symbols usually with some information preprinted upon the board either in some of the spaces or along the edges. The player then employs his numbers and/or symbols to form equations and the like. Sometimes an opponent plays upon the same board and employs numbers or indicia already placed upon the board by the first player so that the opponent can form his own equations for his scoring. In such games, the players have a plurality of numbers and/or indicia from which they can select before making their play. The present invention is a new and challenging game of the latter type.

SUMMARY OF THE INVENTION

It is accordingly one object of this invention to provide an educational game requiring skill and judgement to win the game.

A further object of the invention is to provide an educational game which utilizes a random selector means to select a given number and game board means on which the selective number is entered.

A still further object of the invention is to provide an educational game wherein the skill of the player is utilized to select given numbers and then place these numbers in the correct spaces on a game board in order to arrive at a numerical solution for the game.

A still further object of the invention is to provide a plurality of random selector means, game board means and numerical token means, by which several players can compete against each other using their judgement and skill in order to be the first to arrive at the numerical solution to their particular game.

Other objects and advantages of the present invention will become apparent as the description thereof proceeds.

In satisfaction of the foregoing objects and advantages there is provided by this invention an educational game requiring judgement and skill to become a winner by arriving at the correct numerical solution, the game being adaptable for play by several players wherein each player may have the same or a different numerical solution to his particular game, each of said games comprising:

a. a playing surface containing a game board wherein the game board is divided by rows and columns of four in number into sixteen spaces, each of said spaces being adapted to receive a numbered token, the game board being further identified as having a particular numerical solution;

b. a random number selection means adapted to select a number from a disc means which carries numbers thereon;

c. disc means provided with a plurality of numbers thereon and being adapted to be placed on said random selector means for the selection of a number on said disc; and d. a plurality of numbered token means, the numbers on said tokens corresponding to the numbers on said disc means;

wherein selection of a number by the random selector means on the disc requires the player to insert a token having a corresponding number on one space of said game board and whereby the numbers must be placed on the game board in such manner as to provide the indicated numerical solution of the game board when the numbers are added in each row, in each column, in each diagonal, or of any four numbers in a square.

BRIEF DESCRIPTION OF THE DRAWING

Reference is now made to the drawings accompanying this application wherein FIG. 1 represents one embodiment of the game board providing a playing space, a random selector means and the playing board surfaces;

FIG. 3 is a perspective view of a numbered token for use in the game;

FIG. 4 shows container means for placing the various elements of the game in compact relationship; and FIG. 5 shows means for storage of the disc means for placing in the container.

DESCRIPTION OF PREFERRED EMBODIMENTS

Figure 2:
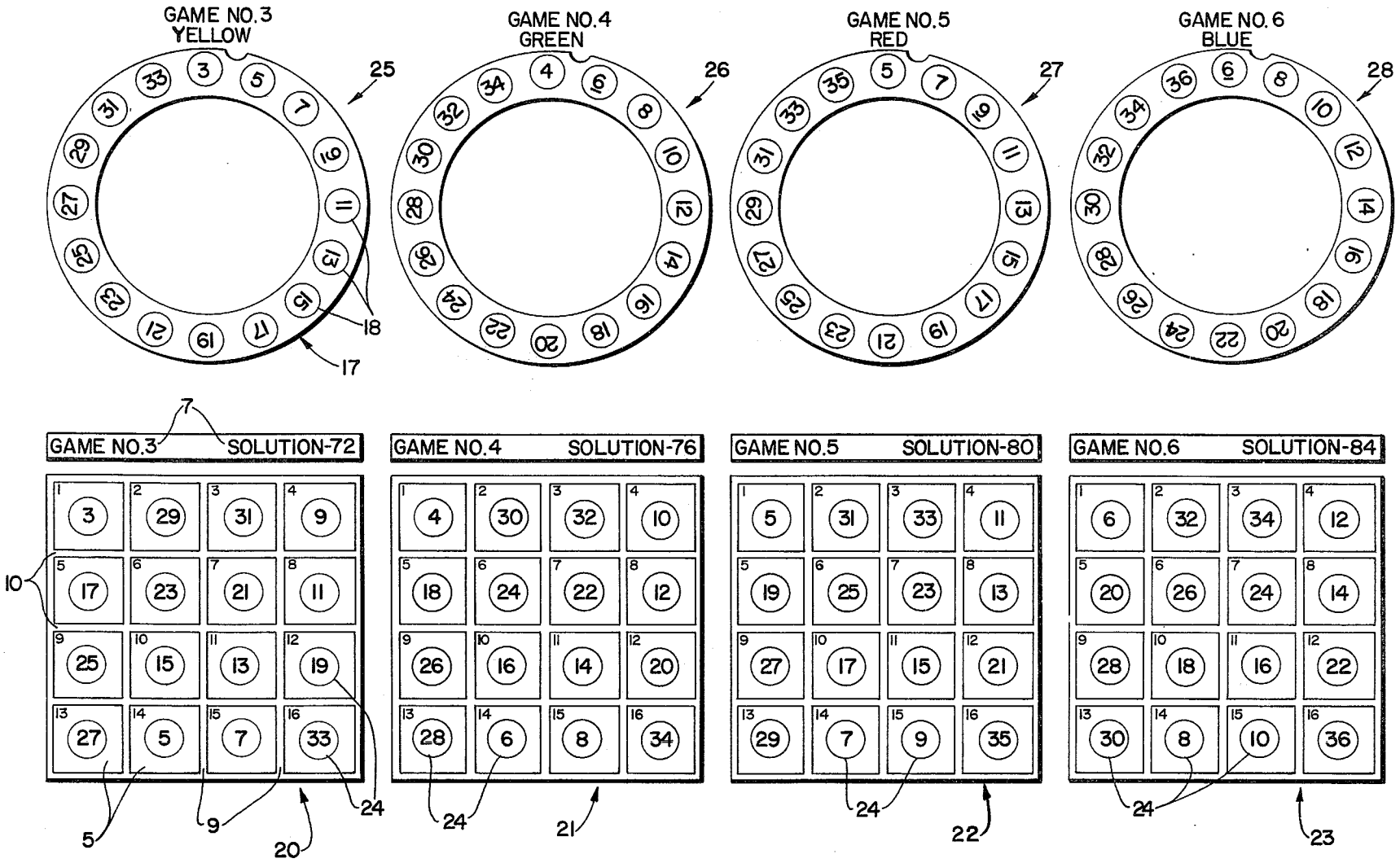
FIG. 2 shows game boards of four of the games of the invention containing the numerical tokens inserted thereon in the proper order to give the correct solution to each game, and disc means by which the numbers are selected for each of the indicated games.

As indicated above, this invention is concerned with an educational game in which the object is for each player to arrive at the correct numerical solution for the game in the earliest possible time. The game is properly described as a Multiplicator Puzzle Game. The game comprises a playing surface or game board divided by rows and columns into sixteen spaces on which numbered tokens are inserted in order. The order of insertion of the numbered tokens to be played is determined by use of a random selector means on which is placed a particular disc for that game. The disc is provided with numbers which have been arranged so that proper selection will result in the numerical solution to the game. The numbered tokens correspond in number to the spaces on the playing surface and to the numbers on each disc. The total invention comprises a plurality of games with four separate games illustrated herein as Games 3, 4, 5 and 6, the numbers of the games being derived from the last digit of the diagonal on each game board. The game may be played by two or more players and may be played by each player selecting a game which will provide the same solution or by selecting games which will provide different solutions.

As will be appreciated, the game is a game of skill which requires the proper placing of the numbered tokens so that addition in any direction will result in the correct numerical solution of the game. It requires each player to exercise that judgement necessary to place the numbered token in the correct space in order to arrive at the particular numerical solution and the first player to reach the correct solution to his game is the winner.

Reference is now made to the drawings accompanying this application wherein like numerals represent like objects and wherein are set forth the specific elements of the game and also indicate the method by which the game is played together with the numbers to be placed on the tokens and discs and the numerical solutions to each indicated game.

Reference is initially made to FIG. 1 which shows a typical set-up for playing the game of this invention for two players when both players are playing the same game board. As may be seen, each game comprises a playing surface for two game boards, a corresponding disc and a number selector means. Thus as shown in FIG. 1, there is shown a set-up for playing a game in which each player plays Game No. 3. The set-up comprises a planar playing surface constructed of wood, plastic, cardboard or the like, and containing surfaces 2 and 2' for placing game boards thereon. Also provided is surface 3 for the random selector means and identifying indicia or logo 4. Further recessed storage areas 5 and 5' are provided for numbered tokens used in the game.

In FIG. 1, the game is set-up with game boards 6 and 6' for playing Game No. 3. The particular game being played and solution for that game, in this case Game No. 3, Solution-72, may be indicated in the margin or border as by reference numeral 7 and 7'. The surface of each game board is divided into sixteen substantially equal sections 8 and 8', the division being made by rows and columns by use of longitudinal markings 9 and 9' and horizontal markings 10 and 10'. By use of these markings, the game surface is divided into a total of sixteen separate areas 8 and 8'. Each of these areas is further numbered by small numeral indicia 11 and 11' from 1 to 16 in the upper left-hand corner. Each of the game board surfaces of all the games are identical except for the identifying indicia in the margin or otherwise on the boarder to identify the games.

The playing surface of each game board is preferably a substantially planar material and may be wood, paper, cardboard or synthetic polymer composition material. The longitudinal and lateral markings which divide the board into a plurality of rows and columns intersect each other to define the plurality of spaces numbered 1 to 16. The longitudinal and lateral markings may be formed on the game board by any convenient or conventional means. Thus, when the game board is wood, paper or cardboard, the markings can be printed upon the top surface of the game board and when the game board is of wood or synthetic polymer composition material, the markings can be formed by raising or depressing below the general surface thereof. It is preferred that the markings be raised so as to leave the spaces 8 and 8' as slightly recessed spaces to receive the tokens and retain them in place.

The random numeral selection means is indicated generally by reference numeral 12 and generally comprises a base 13 having a spinner 14 thereon, the spinner 14 having an indicating pointer 15 on one end thereof. The base 13 is also provided with a generally recessed circular portion 16 so that a circular disc can be mounted on the random selector spinner means. The disc is indicated by numeral 17 and generally comprises a paper, wood or cardboard disc of the appropriate size and carrying substantially evenly spaced numbers 18 thereon. The disc is adapted to be placed onto the selector means 12, preferably by insertion into the recessed portion indicated at 16. The disc 17 is provided with substantially evenly spaced numbers 18 and these numbers are selected by the random selector after mounting of the disc thereon. The numbers on each disc are those numbers which when inserted in the proper order on the game board will provide the numerical solution. In Game No. 3, the numbers on the disc are odd numbers beginning with 3 and ending with 33, covering all odd numbers there between. For purposes of illustration, numerals 19 are shown at the inner border of disc 17 and these numbers indicate the numbered spaces of Game No. 3 at which these numerals should be inserted to arrive at the proper game point solution. However, in playing the game this information would not be readily available to the players.

Reference is now made to FIG. 2 where there are shown Game Numbers 3, 4, 5 and 6 including the disc for each game, and each game board surface having the numbered tokens placed thereon to provide the proper solution for each game. As can be determined, other games can be devised having different numerical solutions but using the principles of this game. Each of Games 3, 4, 5 and 6 are indicated by reference numerals 20, 21, 22 and 23, respectively. Reference is specifically made to Game No. 3 which was the game illustrated in FIG. 1, as all the game boards are identical except for the indicia and tokens placed thereon. In Game No. 3, game board 20 is indicated as having been divided by longitudinal markings 9 and lateral markings 10 into sixteen spaces 8 as discussed for FIG. 1. The game board or surface also carries the identifying indicia and point solution in the border 7. Each game board 20, 21, 22 and 23 is further shown as having the numbered tokens placed in each of the spaces in this game. In each game the numbered tokens 24 placed as shown in this drawing indicate the solution to each game and the solution may be arrived at by adding the numbers on the tokens in each of the squares in the horizontal direction of any row, in the vertical direction of any column, in either diagonal direction or by addition of the numbers of any square formed by the tokens. Thus, to illustrate, in Game No. 3 the addition of the numbered tokens in squares 1, 2, 3 and 4 provide a solution of 72 points. Addition of the numbers in vertical columns 1, 5, 9 and 13 also provide the solution of 72 points. Further, addition of the numbers in the square in the lower left-hand corner identified by the numbers 9, 10, 13 and 14 provides the solution of 72 points.

When the tokens are placed as shown, the correct solution of the game has been obtained.

The same type of system is shown for Game Numbers 4, 5 and 6 on boards 21, 22 and 23, respectively, wherein the game boards, while using different numbers and providing different solutions, are also required to be solved in the same way. Thus, it requires proper placing of the numerical tokens in the proper spaces in order to arrive at the solution of 76 points for Game No. 4, 80 points for Game No. 5 and 84 points for Game No. 6, respectively. In these games the same rule holds in that the addition of any four numbers, vertically, horizontally, diagonally or in any four spaces which form a square, provide the solution to the game.

With Game Numbers 3, 4, 5 and 6 there are also provided appropriate discs to be used for each game. These discs are identified as yellow disc 25, green disc 26, red disc 27 and blue disc 28, the colors being used merely to easily identify each disc. Each disc and game board should usually be the same color for easy identification. As indicated, the yellow disc is for use with Game No. 3, the green disc is for use with Game No. 4, the red disc is for use with Game No. 5 and the blue disc is for use with Game No. 6. The discs are as described in FIG. 1 comprising generally a circular structure of cardboard, paper, wood or the like having numbers printed or otherwise placed thereon in the appropriate order. As will be noted, the yellow disc for Game No. 3 contains odd numbers from 3 to 33, generally spaced evenly in the circle. The green disc for Game No. 4 contains even numbers from 4 to 34 spaced generally evenly about the circle. The red disc for Game No. 5 contains odd numbers from 5 to 35 spaced generally evenly about the circle, and the blue disc for Game No. 6 contains the even numbers from 6 to 36 spaced generally evenly about the circle.

In playing the game each player selects a playing board and an appropriate number of tokens containing the referenced numerals. Each player may select the same game number or the players may use a different game number. If the same game number is used then the disc corresponding to that game number is placed on the random number selector and any method of selecting the player to go first may be used. At that point, the first player operates the random selector to determine his first number. On determination of his first number he then inserts the token number in any desired position on the game board. As indicated in FIG. 1, if the pointer should stop at the number 31 in playing GAme No. 3, the number 31 should be placed in space No. 3. However, the player will not have these solutions available. The second player then operates the random selector to select a number for the insertion of his first referenced token and so forth while each player taking turns in selecting his number until all spaces are filled. The first player to arrange his tokens and therefore arrive at the proper solution to the puzzle or game is the winner. In the case of Game No. 3, the game solution is 72 points and as indicated above, the numerical value of 72 must be shown on the completed board when adding the numbers horizontally, vertically, diagonally or in any four adjacent squares. Obviously, the first space selected by the player may not necessarily be the space at which he will ultimately desire to place the numbered token. It will be apparent that as play proceeds and as more tokens are obtained, the referenced tokens will have to be moved in order to arrive at the correct solution.

Reference is now made to FIG. 3 which shows a numbered token utilized in the game of this invention. As indicated in FIG. 3, the numbered token 29 is generally square and carries a number 30 thereon, in this case the number 3. The token 24 is preferably square, but may be square or any desired shape. It is preferably a small 1¼ inch wood or plastic square or disc having a thickness of about ¼ inch and having an appropriate number printed, indented or raised thereon. The numbered token 29 is used by the player to insert in the various spaces on the game board or playing surface. A sufficient plurality of tokens is provided for each player to play any number selected by the random selector means from any of the discs utilized in playing the game.

There are also further provided storage means for the game as shown in FIGS. 4 and 5. In FIG. 5 there is shown a storage means 31 for receiving the various discs used in the game. This storage means 31 is constructed of wood, cardboard or plastic and generally comprises a bottom planar surface 32 and an elevated top surface 33. This arrangment provides slots or openings 34 for receiving discs 25, 26, 27 and 28 as shown in FIG. 5.

All the components of the game are adapted to be stored in case or carton 35 of FIG. 4 which is provided with handle 36. The case, carton or box 35 may be constructed of any material and has a removable top, e.g. by hinges, to provide a rectangular surface area for reception of the playing surface and game boards. Preferably the disc storage means of FIG. 5 is placed in a recessed area under playing surface 1 when storing the components. However, any other type of container storage means may be used.

The invention has been described herein by reference to certain preferred embodiments. However, as obvious variations thereon will become apparent to those skilled in the art, the invention is not to be considered as limited thereto.

What is claimed is:

1. An educational game comprising:

a. at least one game board surface divided into sixteen substantially equal spaces having four spaces in each direction and being divided laterally and longitudinally in order to define separate individual spaces for the reception of numbered tokens;

b. a plurality of numbered tokens containing numerals thereon, said tokens to be placed within the sixteen spaces of the game playing board;

c. disc means comprising a generally circular disc having reference numerals thereon which correspond identically to the numerical tokens to be placed on the game board;

d. random selector number means providing means for reception of said disc and for selecting any of said numbers on said disc by random means;

whereby on selection of a number on said disc by said random selector means, a numerical token corresponding identically to that number is inserted into one of said sixteen spaces on said game surface, said selection of numbers and insertion of numerical tokens continuing until all of the sixteen spaces on said game board contain numerical tokens whereby the tokens must provide the indicated numerical solution to the game by the addition of said numerical tokens when added longitudinally, latitudinally, diagonally or any four adjoining spaces.

2. A game according to claim 1 wherein the sixteen spaces of each game board are sequentially numbered from 1 to 16.

3. A game according to claim 2 including a plurality of game boards wherein each game board has a different numerical solution marked thereon.

4. A game according to claim 1 wherein each game board contains the numerical solution marked on one border thereof.

5. A game according to claim 1 wherein the numbers on said numbered tokens are printed thereon.

6. A game according to claim 1 wherein the random selector means comprises a base, spinner means thereon and circular recessed means for reception of said disc means.

7. A game according to claim 6 wherein a plurality of disc means are provided which provide different numerical solutions when numbers are selected therefrom.

8. A game according to claim 7 wherein the numbers on said disc means are odd numbers ranging from 3 to 33 inclusive.

9. A game according to claim 7 wherein the numbers on said disc means are even numbers ranging from 4 to 34 inclusive.

10. A game according to claim 7 wherein the numbers on said disc means are odd numbers ranging from 5 to 35 inclusive.

11. A game according to claim 7 wherein said numbers on said disc means are even numbers ranging from 6 to 36 inclusive.

12. A game according to claim 1 including means for storage of said disc means.

13. A game according to claim 1 including storage means for said disc means, said random selector means and said game board means, and said numbered token means.

14. A game according to claim 1 wherein said game board, disc means and numbered tokens are constructed of a member selected from the group consisting of wood, plastic and cardboard.

15. A game according to claim 1 wherein the game board and corresponding disc means are color coded for identification.

16. A game according to claim 1 wherein said playing surface has a recessed area for retaining said numbered token.

17. A game according to claim 1 wherein the numbers on said disc means are odd numbers ranging from 3 to 33 and the solution to the game is 72 points when the numbers on the disc are properly placed on the game board and are added longitudinally, latitudinally, diagonally or in any four adjacent squares.

18. A game according to claim 1 wherein the numbers on said disc means are even numbers ranging from 4 to 34, inclusive, and the solution to the game is 76 points when the numbers on the disc are properly placed on the game board and are added longitudinally, latitudinally, diagonally or in any four adjacent squares.

19. A game according to claim 1 wherein the numbers on said disc means are odd numbers ranging from 5 to 35 and the solution to the game is 80 points when the numbers on the disc are properly placed on the game board and are added longitudinally, latitudinally, diagonally or in any four adjacent squares.

20. A game according to claim 1 wherein the numbers on said disc means are even numbers ranging from 6 to 36 and the solution to the game is 84 points when the numbers on the disc are properly placed on the game board and are added longitudinally, latitudinally, diagonally or in any four adjacent squares.

* * * * *